United States Patent [19]

Vierling

[11] Patent Number: 5,053,590

[45] Date of Patent: Oct. 1, 1991

[54] MOUNT FOR ATTACHMENT OF A SWITCH OPERATING MECHANISM TO A SWITCH

[75] Inventor: Chester J. Vierling, Stone Mountain, Ga.

[73] Assignee: Siemens Energy & Automation, Inc., Alpharetta, Ga.

[21] Appl. No.: 604,558

[22] Filed: Oct. 26, 1990

[51] Int. Cl.[5] ..... H01H 1/58

[52] U.S. Cl. ..... 200/293; 200/DIG. 6; 200/335; 200/50 C; 200/303; 200/400

[58] Field of Search ..... 200/293, 337, 335, DIG. 6, 200/400, 401, 50 C, 303, 307

[56] References Cited

U.S. PATENT DOCUMENTS

| | | | |
|---|---|---|---|
| 1,378,232 | 5/1921 | Horton | 200/293 X |
| 1,578,422 | 3/1926 | Getchell . | |
| 1,910,205 | 5/1933 | Frank | 200/338 X |
| 3,368,053 | 2/1968 | Groves | 200/293 |
| 3,684,849 | 8/1972 | Zubaty . | |
| 4,156,121 | 5/1979 | Klein et al. | 200/293 |
| 4,302,643 | 11/1981 | Cox et al. . | |
| 4,497,992 | 2/1985 | Kodera et al. | 200/400 |
| 4,506,121 | 3/1985 | Peterson et al. | 200/401 X |
| 4,760,364 | 7/1988 | Ostby | 200/293 X |

*Primary Examiner*—Ernest G. Cusick

*Attorney, Agent, or Firm*—Peter A. Luccarelli, Jr.; James G. Morrow

[57] ABSTRACT

A multi-phase switch assembly (10) has a base (12) and an operating mechanism (14). The base (12) and operating mechanism (14) are formed to fit together as an integrated unit by sliding engagement of the base (48) of framework (32) between bosses (30,31) of the base (12) of the switch. Fastener holes (74,76) extend through both the base (12) of the switch and the operating mechanism (14) so that the entire switch assembly (10) can easily be mounted as a unit.

9 Claims, 4 Drawing Sheets

MOUNT FOR ATTACHMENT OF A SWITCH OPERATING MECHANISM TO A SWITCH

TECHNICAL FIELD

The present invention relates generally to switches and more particularly to an integrated multi-phase switch assembly which is easily mounted.

BACKGROUND OF THE INVENTION

A multi-phase switch is typically mounted in an enclosure and includes a line terminal and a load terminal for each phase of a multi-phase circuit The switch usually has a base and an operating mechanism with pivotable blades which pass through arc chambers until they engage a stationary contact. In this position, the current freely passes through the switch. A lever may be moved back and forth to raise or lower the knife blades, thus disconnecting or connecting the circuit.

One type of known fusible switch assembly for a multiphase circuit includes an insulating line base, a plurality of terminals, multiple knife blades which are connected to one set of terminals, and contacts connected to another set of terminals. The knife blades can be rotated against the contacts, so that current flows through the switch, by a rotor mechanism. Included with the switch assembly is a load base assembly which connects with the line base through respective fuses.

Other types of switches externally mount the operating mechanism to one or two opposing side portions of the base with fasteners, which require additional assembly and alignment operations during manufacture.

Yet other types of switches mount the operating mechanism to the external enclosure rather than to the switch base, as exemplified by U.S. Pat. No. 3,684,849.

A problem with any of the above-described switches is the difficulty involved in mounting or replacing them. The operating mechanism often must be separately mounted to the base and the base mounted to the outer enclosure. There remains a need for a switching assembly where the switch base and operating mechanism are fitted together and easily mounted simultaneously.

SUMMARY OF THE INVENTION

The present invention is directed to a switch assembly, comprising a base formed of electrically insulating material and having at least one cavity and a bottom surface. The switch assembly has a blade pivotally mounted within at least one of the cavities, a terminal and electrical contact with at least one of the blades, and respective contact points for engagement with at least one blade when the switch assembly is in a closed position. The switch assembly also has an operating mechanism for movement of the blades between an open and a closed position, directly attached to the base bottom surface by means for sliding engagement therewith.

The present invention is also directed to a switch assembly comprising a base having at least one cavity extending upwardly from a bottom surface and at least one boss extending downwardly from the bottom surface. The switch assembly has a terminal mounted in at least one of the cavities and connected to a pivotable blade and contact points mounted in at least one of the cavities and disposed so that the blade can be pivoted into contact with the contact point. The switch assembly also has an operating mechanism including a bail, a bail insulator between the bail and the blades, a cam for pivoting the bail, means for triggering the bail, and a framework for mating engagement with the bottom surface of the base between the base bosses.

BRIEF DESCRIPTION OF THE DRAWINGS

A preferred exemplary embodiment of the invention will be described in conjunction with the appended drawings, wherein like numerals denote like elements, and.

DETAILED DESCRIPTION OF A PREFERRED EXEMPLARY EMBODIMENT

Figure 1:
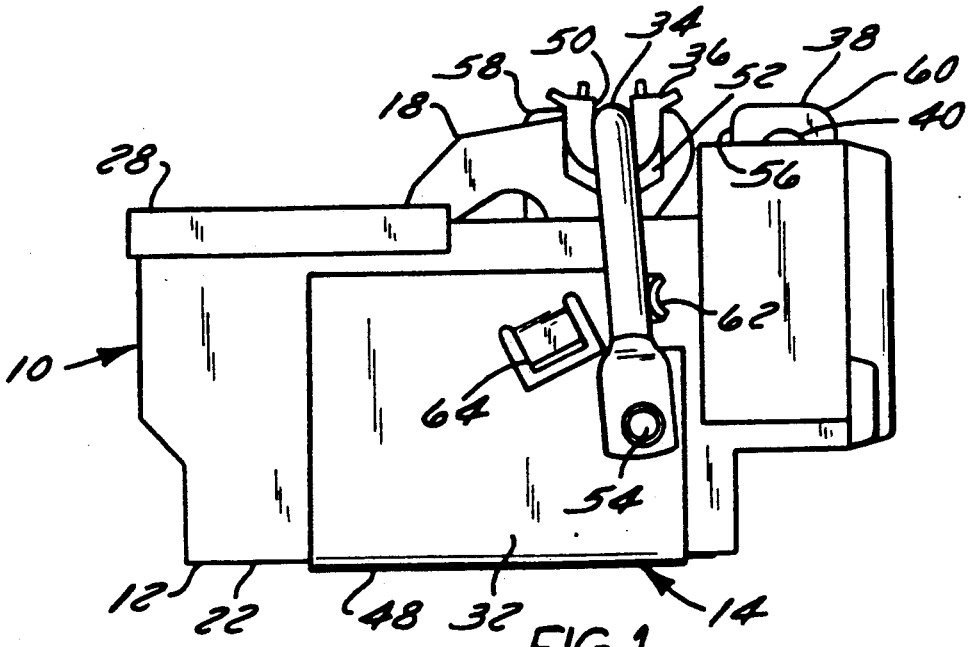
FIG. 1 is a left side view of a switching assembly of the invention.
Figure 7:
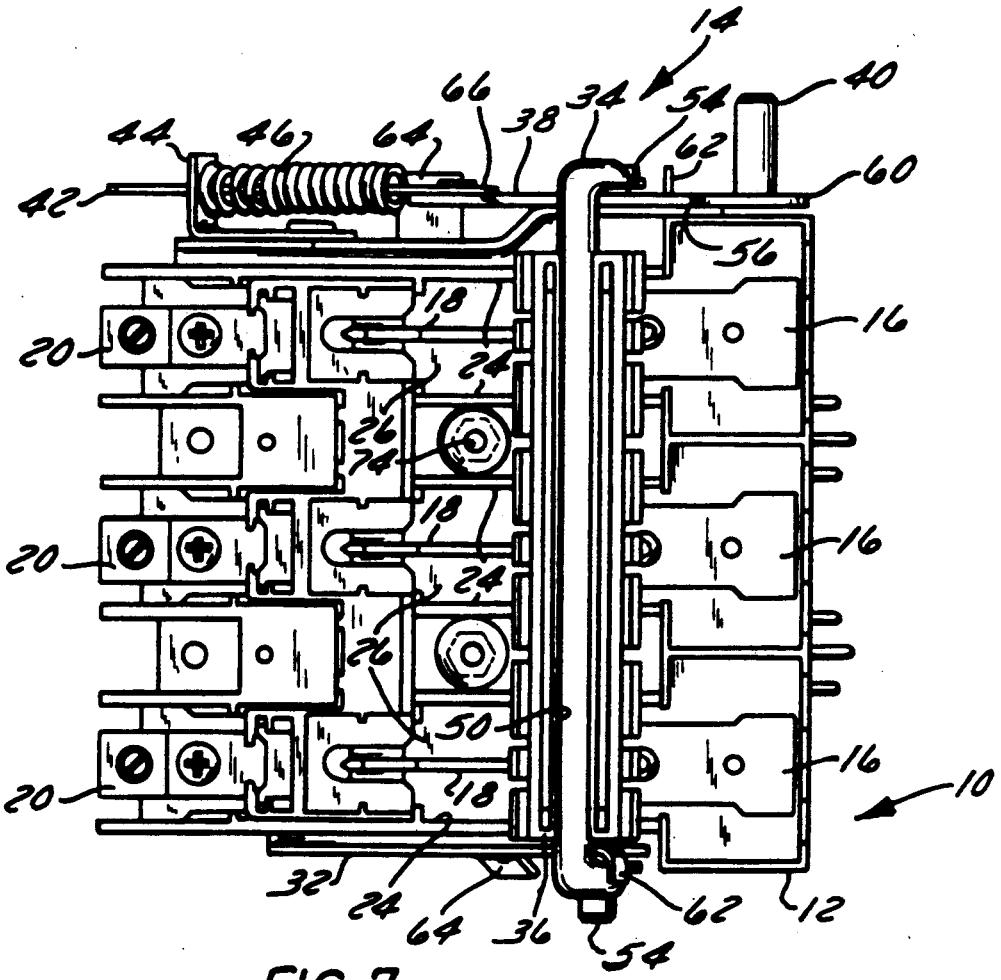
FIG. 7 is a top view of the invention with the line shield removed.

As illustrated in FIGS. 1 and 7, a multi-phase switch 10 in accordance with the invention comprises a base 12 made from electrically insulating material, an operating mechanism 14, respective terminals 16, respective blades 18, and contact points 20. Blades 18 are pivotally attached to terminals 16 so that they can be pivoted to engage points 20. Operating mechanism 14 functions to move rapidly blades 18 into and out of the vicinity of contact points 20, so that minimal arcing occurs between blades 18 and contact points 20 when the switch is opened or closed.

Figure 2:
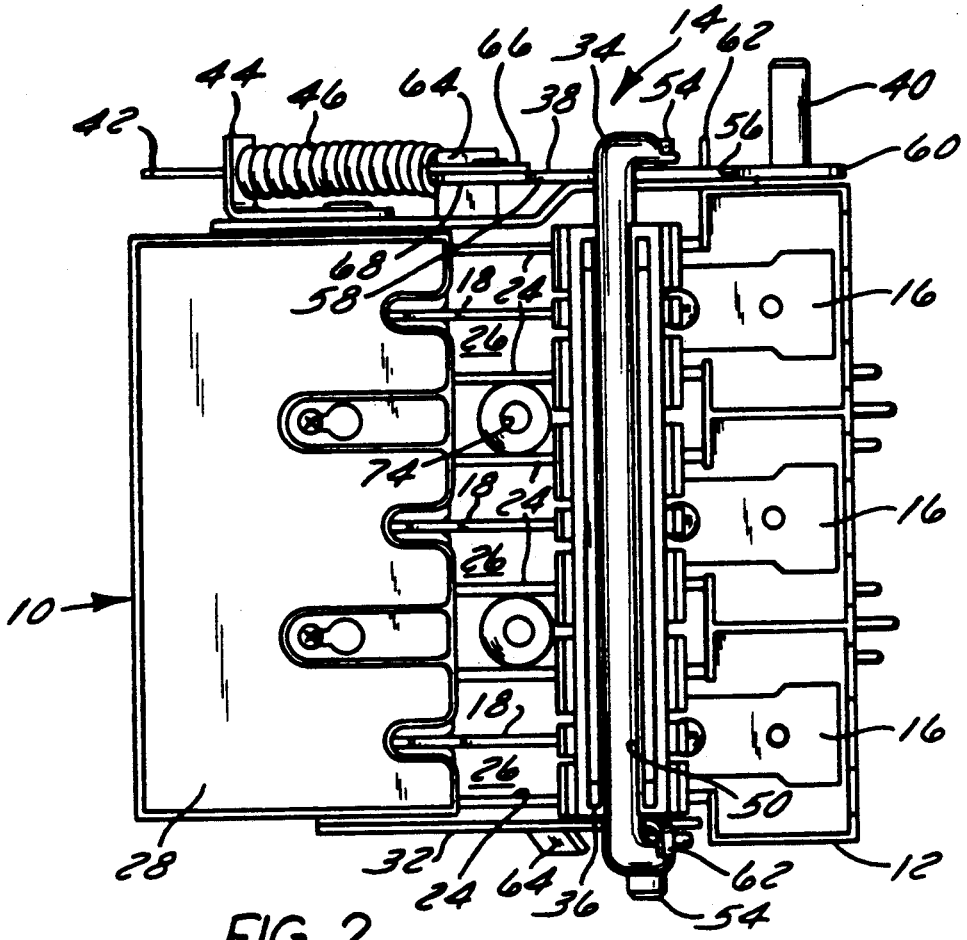
FIG. 2 is a top view of the invention.
Figure 3:
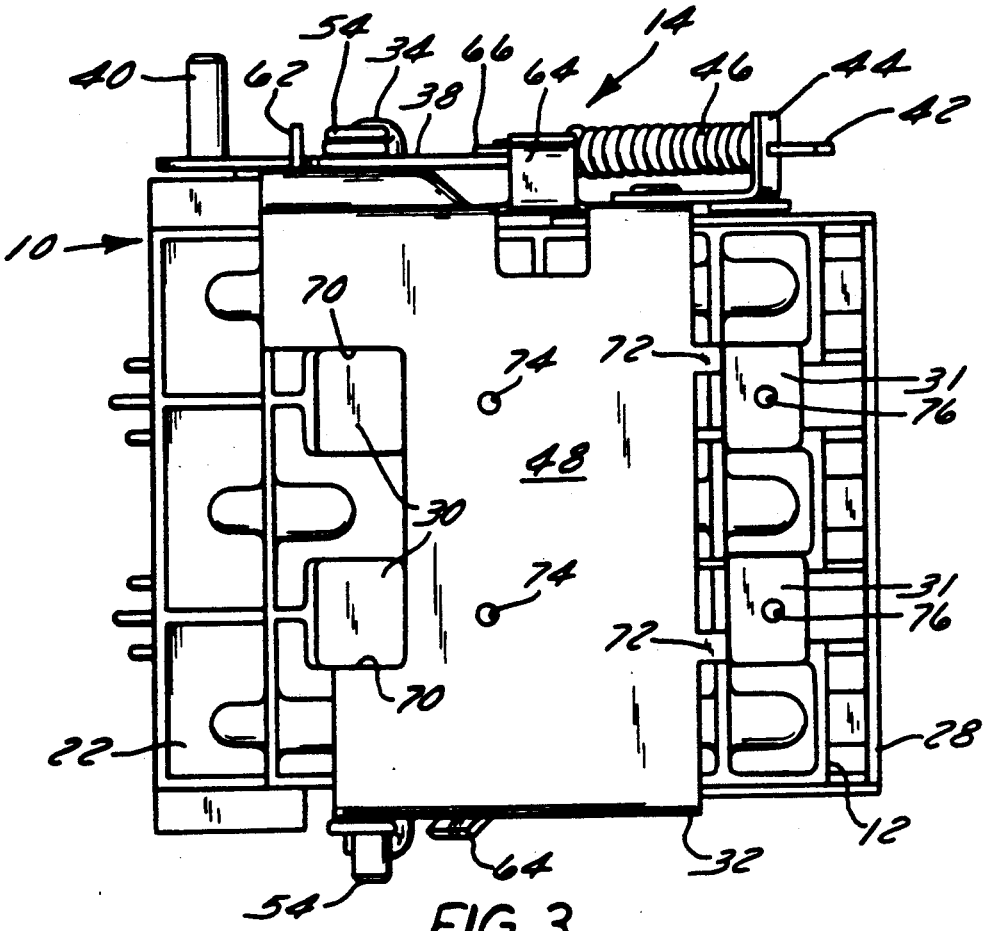
FIG. 3 is a bottom view of the invention.

Referring to FIGS. 2 and 3, base 12 includes a bottom surface 22 from which extends a plurality of substantially vertically disposed walls 24 defining cavities 26 therebetween partially covered by a cover 28. Extending downwardly from bottom surface 22 are respective bosses 30 and respective bosses 31, which, as described below, help to hold operating mechanism 14 in place.

Figure 4:
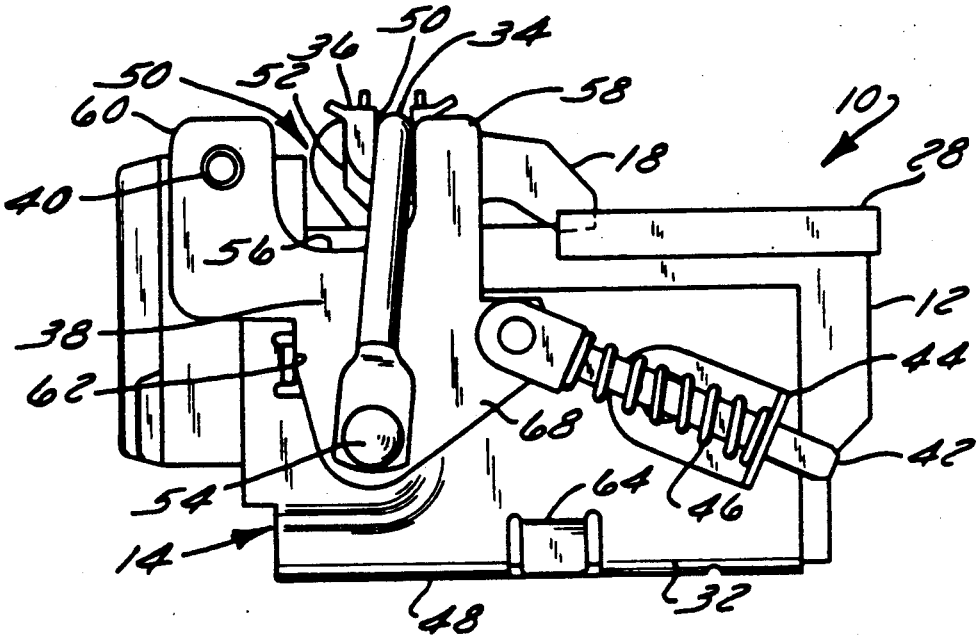
FIG. 4 is a right side view of the invention showing the blades in open position.

As shown in FIGS. 3 and 4, operating mechanism 14 comprises a framework 32, a bail 34, a bail insulator 36, a cam plate 38, a drive pin 40, a spring guide 42, a pivoting spring retainer 44, and a spring 46. Framework 32 has a base 48 which extends along the bottom surface of base 12 and cooperates with bosses 30 and 31. Bail 34, cam 38, and pivoting spring retainer 44 are all rotatively fastened to framework 32.

Bail insulator 36 is a single piece of insulating material which functions to insulate electrically bail 34 and blades 18 and is formed into a U-shaped channel defining a long, narrow groove 50 in which bail 34 rests. Blades 18 each have a recessed portion 52 into which bail insulator 36 fits. This ensures that blades 18 will move back and forth in cooperation with bail 34. Blades 18 are pivotally attached to terminals 16, so that the blades actually pivot back and forth when bail 34 moves, as shown in FIG. 2.

Bail 34 is pivotally attached at its distal ends to framework 32 by a pair of pins 54. Cam plate 38 is pivotally secured on one side of framework 32 by one of pins 54. As best seen in FIG. 4, cam plate 38 is provided with a plurality of arms or extension 58, 60 and 68. Arms 58 and 60 define an oversize slot 56 in the top of cam 38 in which the cross arm of bail 34 is disposed.

Figure 5:
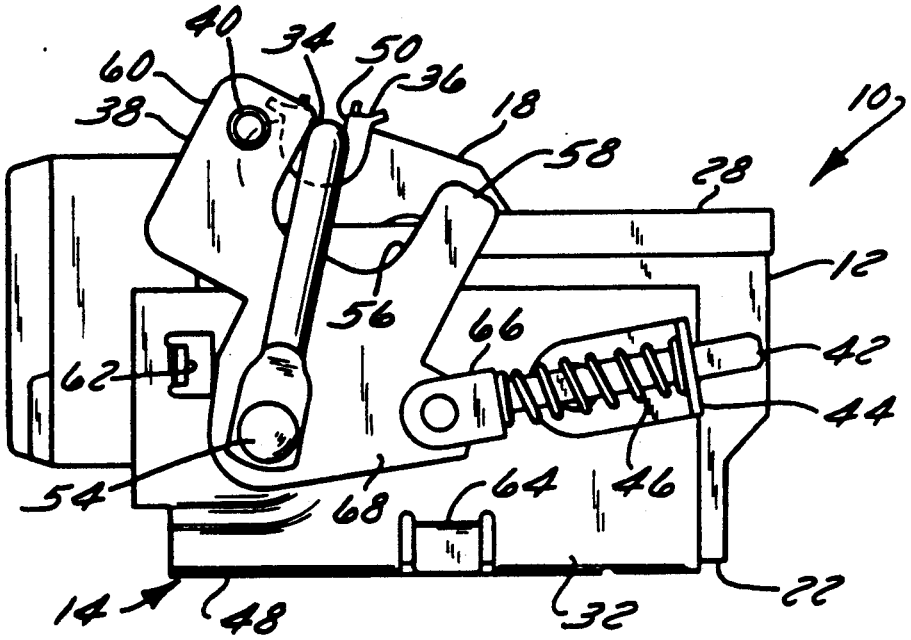
FIG. 5 is a right side view of the invention showing the operating mechanism at its half-way point.
Figure 6:
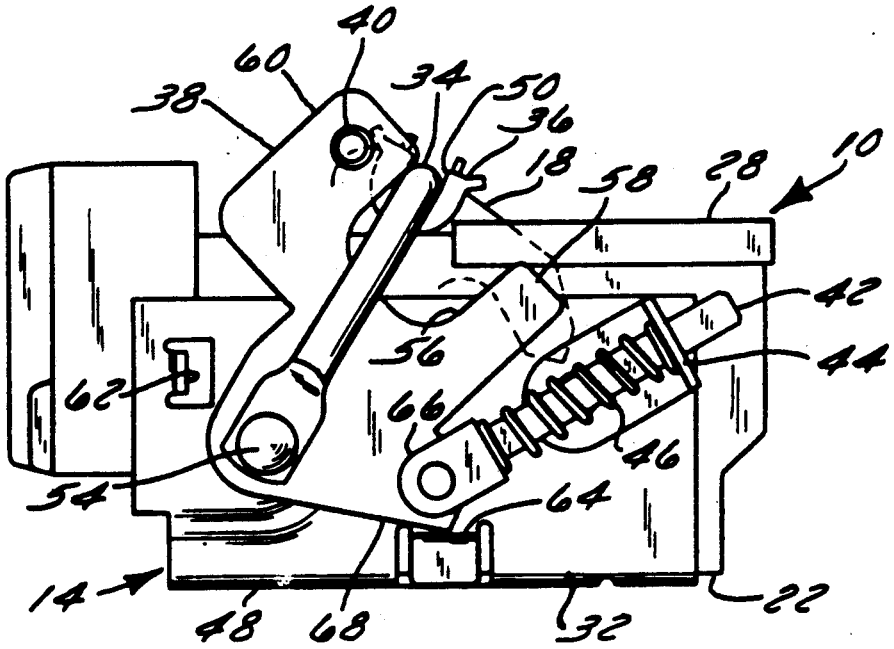
FIG. 6 is a right side view of the invention showing the blades in a closed position.

As depicted in FIG. 4, when the switch is opened, opening extension 58 comes into contact with bail 34 in order to move bail 34 and blades 18 away from contact points 20. Similarly, when the switch is closing, as shown in FIG. 5, cam 38 is rotated so that closing arm 60 comes into contact with bail 34 and moves both bail 34 and blades 18 toward contact points 20.

In order to minimize arcing as blades 18 move into and out of proximity to contact points 20, spring 46 is used to effect rapid movement of the blades. Spring 46 is held between a flared end 66 of spring guide 42 and spring retainer 44. Spring guide 42 is slidably mounted in spring retainer 44 and rotatably mounted to a cam arm 68. When closing the switch, cam 38 is rotated about pivot pins 54, compressing spring 46 between flared end 66 and spring retainer 44. This intermediary position between the open and closed positions is illustrated in FIG. 5. The force of spring 46 is directed through the pivot axis of cam plate 38 defined by its pin 54. Shortly after closing, cam 60 comes into contact with bail 34, cam arm 68 rotates about pivot pin 54 far enough so that the force of spring 46 is no longer acting through the pivot axis, thus spring 46 triggers and forces cam 38 to rotate rapidly about pivot pins 54 until cam 38 comes to rest against mechanical stops 64. This rotating cam forces bail 34 to rotate rapidly and consequently, blades 18 are quickly brought into engagement with contact points 20. Similarly, when the switch is opened, cam 38 is rotated in the opposite direction until opening extension 58 comes into contact with bail 34. Shortly after this point, cam extension 68 has rotated far enough about pivot pins 54 so that spring 46 will trigger and quickly rotate bail 34 and blades 18 away from contact points 20.

When the switch is opened, cam 38 comes to rest against respective mechanical stops 62, and when the switch is fully closed, cam 38 comes to rest against respective mechanical stops 64.

To simplify the mounting of switch assembly 10 into an enclosure, base 12 and operating mechanism 14 are designed for easy mounting as a unit by sliding engagement therebetween. Referring to FIG. 3, framework 32 of operating mechanism 14 slides around base 12 so that they can be mounted as an integrated unit. Base 48 of framework 32 fits between bosses 30 and 31 of base 12. Bosses 30 are disposed so that they fit within a cutout area 70 of base 48 and about base 12. Bosses 31 are located on the opposite side of lower portion 48 and disposed so that a pair of tabs 72, extending from base 48 and bosses 31 are in abutting, engaged relationship. The abutting, engaged relationship allows the registration and alignment of fastener holes 74 in base 12 to fastener holes 74 in base 48. In addition, respective fastener holes 76 extend through bosses 31. Thus, switch assembly 10 can be simultaneously secured together by sliding engagement as one unit, i.e., base 12 secured to base 48, and mounted to a support within an enclosure using common fasteners. This is easily accomplished by holding switch 10 with base 12 and base 48 in registry and inserting fasteners through holes 74 and 76.

It will be understood that the above description is of a preferred exemplary embodiment of the invention, and that the invention is not limited to the specific forms shown. For example, various fasteners can be used to attach the switch within an enclosure or various configurations of base or operating mechanism may be used. Various other substitutions, modifications, changes, and omissions may be made in the design and arrangement of the elements without departing from the spirit of the invention as expressed in the appended claims.

What is claimed is:

1. A switch assembly, comprising:

a base formed of electrically insulating material, the base having at least one cavity and a bottom surface;

a blade pivotally mounted within at least one of the at least one of the cavities;

a terminal in electrical contact with at least one of the blades;

respective contact points for engagement with at least one of the at least one of the blades when the switch assembly is in a closed position; and an operating mechanism for movement of at least one of the at least one of the blades between an open and a closed position, directly attached to the base bottom surface by means for sliding engagement therewith.

2. The switch assembly of claim 1, wherein the means for sliding engagement is at least one boss projecting from one of the base bottom and operating mechanism, which boss engages the other of the base bottom and operating mechanism.

3. The switch assembly of claim 2, wherein at least one of the base and operating mechanism has at least two bosses in spaced relationship and the other of the base and operating mechanism is engaged between the bosses.

4. The switch assembly of claim 3, wherein the base has the bosses attached thereto and the operating mechanism has a framework that is slidably enageable with the base and capturable between the base bosses.

5. The switch assembly of claim 1, wherein the bottom surface of the base has a plurality of fastener holes and the operating mechanism has respective fastener holes located so that the holes in the base are aligned with the holes in the operating mechanism when the operating mechanism is matingly engaged with the base, thus allowing simultaneous mounting of the base and the bailing mechanism by inserting fasteners through the aligned holes and fastening the entire switch assembly to an exterior housing.

6. The switch assembly of claim 5, wherein there are four fastener holes in the bottom surface of the base and two fastener holes in the operating mechanism, and each hole in the operating mechanism is in alignment with its corresponding hole in the bottom surface when the bailing mechanism and the base are in mating engagement.

7. The switch assembly of claim 1, wherein the operating mechanism further comprises:

a bail having a single bail insulator which connects the bail to the at least one of the at least one of the blades;

a cam connected to the bail and having a drive pin to which a force can be applied to pivot the cam; and means for triggering the bail so that the blades will selectively engage or disengage the contact points.

8. A switch assembly, comprising:

a base having at least one cavity extending upwardly from a bottom surface and at lest two bosses extending downwardly from the bottom surface;

a terminal mounted in at least one of the at least one of the cavities and connected to a pivotable blade;

a contact point mounted in at least one of the at least one of the cavities and disposed so that the blade can be pivoted into contact with the contact point;

an operating mechanism including a bail, a bail insulator between the bail and the blades, a cam for pivoting the bail, means for triggering the bail, and a framework for mating engagement with the bottom surface of the base between the base bosses.

9. The switch assembly of claim 8, wherein the framework and base each have at least one fastener hole in axial alignment when the operating mechanism and base are in mating engagement.

* * * * *